US007302772B2

(12) United States Patent
Harrington

(10) Patent No.: US 7,302,772 B2
(45) Date of Patent: Dec. 4, 2007

(54) COMBINATION WRITABLE SCROLL PICTURE FRAME DISPLAY ASSEMBLY

(76) Inventor: Vernon H. Harrington, 903 Aipo St., Honolulu, HI (US) 96825

( * ) Notice: Subject to any disclaimer, the term of this patent is extended or adjusted under 35 U.S.C. 154(b) by 0 days.

(21) Appl. No.: 11/160,736

(22) Filed: Jul. 6, 2005

(65) Prior Publication Data

US 2007/0113456 A1 May 24, 2007

(51) Int. Cl.
*A47G 1/06* (2006.01)

(52) U.S. Cl. ..... 40/725; 40/358; 40/514

(58) Field of Classification Search ..... 40/725, 40/116, 117, 726, 800, 358, 905, 514
See application file for complete search history.

(56) References Cited

U.S. PATENT DOCUMENTS

| | | | | | |
|---|---|---|---|---|---|
| D21,587 | S | * | 5/1892 | Hemphill | D19/23 |
| 1,179,231 | A | * | 4/1916 | Sherman | 40/117 |
| 1,251,791 | A | | 1/1918 | Leeland | |
| 1,385,140 | A | * | 7/1921 | Martin | 40/116 |
| 1,830,102 | A | * | 11/1931 | Felsenthal | 40/334 |
| 2,111,362 | A | * | 3/1938 | Fisher | 40/335 |
| D147,046 | S | | 7/1947 | Joelson | D29/20 |
| D200,146 | S | | 1/1965 | Mudrinich | D1/3 |
| 3,711,976 | A | * | 1/1973 | Allen | 40/514 |
| D233,874 | S | | 12/1974 | Ashley | D6/234 |
| 4,182,061 | A | | 1/1980 | English | 40/152.1 |
| D353,283 | S | * | 12/1994 | Ford | D6/449 |
| D355,218 | S | * | 2/1995 | Peterka | D19/82 |
| 5,605,001 | A | | 2/1997 | Derk | 40/518 |
| 5,695,066 | A | | 12/1997 | Bartlett | 206/575 |
| 6,347,472 | B1 | | 2/2002 | Dominguez | 40/729 |
| 2002/0007578 | A1 | * | 1/2002 | Martorella | 40/725 |
| 2002/0092216 | A1 | * | 7/2002 | Rice | 40/209 |

FOREIGN PATENT DOCUMENTS

JP (HEISEI) 9-81037 3/1997

* cited by examiner

*Primary Examiner*—Cassandra Davis
(74) *Attorney, Agent, or Firm*—Seth M. Reiss

(57) ABSTRACT

A combination writable scroll picture frame display assembly, comprising a picture frame sized to accommodate commonly sized photographs or cards, a writable scroll, and a base sized and shaped to maintain the entire invention upright and stable. The components are arranged such that the scroll, when mounted, does not obscure viewing the framed picture. The scroll is mounted on the assembly in a manner to facilitate its easy removal and remounting, and the entire assembly may be made wall mountable. The scroll is bound when closed, unrolls to reveal some sort of writable media, and may include a decorative cover and/or other decorative features including decorative end caps. The combination display assembly provides an attractive and convenient way to store inscribable scrolls together with photographs, cards or other two-dimensional graphics that relate to a memorable occasion or event, while at the same time allowing for the easy removal and unfurling of the writable scroll in order to read and exhibit the inscriptions found therein.

6 Claims, 3 Drawing Sheets

COMBINATION WRITABLE SCROLL PICTURE FRAME DISPLAY ASSEMBLY

CROSS-REFERENCE TO RELATED APPLICATIONS

This application does not claim the benefit of any related patent application.

FEDERALLY SPONSORED RESEARCH

The invention described herein is not the result of or in any way related to federally sponsored research or development.

BACKGROUND

1. Field of the Invention

This invention relates to displays. More specifically, this invention describes a display assembly that accommodates a writable scroll in combination with a picture frame.

2. Description of Prior Art

Display frames, including picture frames and framed mirrors, as mechanisms for holding and displaying photographs, two dimensional graphic images, and mirrors, are well-known and understood. Display frames come in a variety of types, shapes and sizes, and have been shown and described in combination with other utilitarian or ornamental components including, for example, calendars and personal items. Display frames have not however, been shown or described in combination with scrolls.

Scrolls are also well-known and understood, and a great variety of scrolls are commercially available. Some scrolls are pre-printed, like books, or decorated, like pictures, and meant to be read and/or displayed. Other scrolls are writable, functioning like a paper pad or notebook, and come with their rolled paper blank. Scrolls are available in a variety of materials, may have ornamental features, and can be supplied with or without a cover.

In some communities and cultures writable scrolls are given as gifts at honorific events. Such events might include graduations and retirement parties, awards programs and the like. The recipient of the scroll asks guests in attendance to inscribe and sign the scroll in order to better memorialize the event for the benefit of the honoree. The honoree then preserves the inscribed scroll and may display it. Although displayed, the honoree may wish to unfurl the scroll to review the inscriptions, or exhibit the inscriptions for others to read.

It is a primary object of the subject invention to provide a convenient means for displaying a writable scroll commemorating a memorable event. It is a further object of the subject invention to provide a means for displaying a scroll that permits the easy removal and unfurling of the scroll in order that inscriptions on the writable scroll portion can be read before re-furling and returning the scroll for continued display.

It is also typical at honorific events that photographs will be taken and cards given. The honoree may logically wish to preserve the event scroll together with photographs or cards of the event. It is a further object of the present invention to provide a means whereby a writable scroll commemorating an event can be stored and displayed together with one or more photographs commemorating the same or different event, or with photographs of the honoree or subject matter being commemorated, or cards related to the event.

It is a further object of the present invention to provide a means whereby a writable scroll may be displayed together with a photograph or card such that the scroll does not obscure the viewing of the photograph or card while providing for the easy removal of the scroll for reading and easy return of the scroll for continued display.

SUMMARY OF THE INVENTION

These and other problems are solved by the subject invention, a combination writable scroll picture frame display assembly, comprising a picture frame sized to accommodate commonly sized photographs or cards, a writable scroll, and a base sized and shaped to maintain the entire invention upright and stable. The components are arranged such that the scroll, when mounted, does not obscure viewing the framed picture. The scroll is mounted in a manner to facilitate its easy removal and remounting.

The scroll is bound when closed, unrolls to reveal some sort of writable media, and may include a decorative cover and/or other decorative features including decorative end caps.

The display assembly components, base, picture frame and scroll, may be detachable one from the other. According to one embodiment, the picture frame extends from the rear of the base while the scroll is displayed horizontally on supports mounted along the front of the base. According to an alternative embodiment, the scroll is displayed in a vertical position with one end detachably mounted to the base and the opposite end detachably mounted to and supporting the picture frame in an upright position.

The display assembly may be made wall mountable, or may be displayed on top of a flat surface such a mantel or shelf.

The picture frame may be slotted along its top or side edges to receive a photograph or card. Alternatively, graphics may be inserted into the picture frame laterally from the front or rear. The picture frame may display graphics from its front only, or may be two sided, so that a different graphic may be viewed from its front and rear sides.

The combination assembly allows for the convenient and attractive storage and display of a commemorative writable scroll together with related photographs or cards, while allowing for the temporary removal and reading of the scroll.

Further objects and advantages of this invention will become apparent from consideration of the drawings and ensuing description.

DETAILED DESCRIPTION OF PREFERRED EMBODIMENTS

Figure 2:
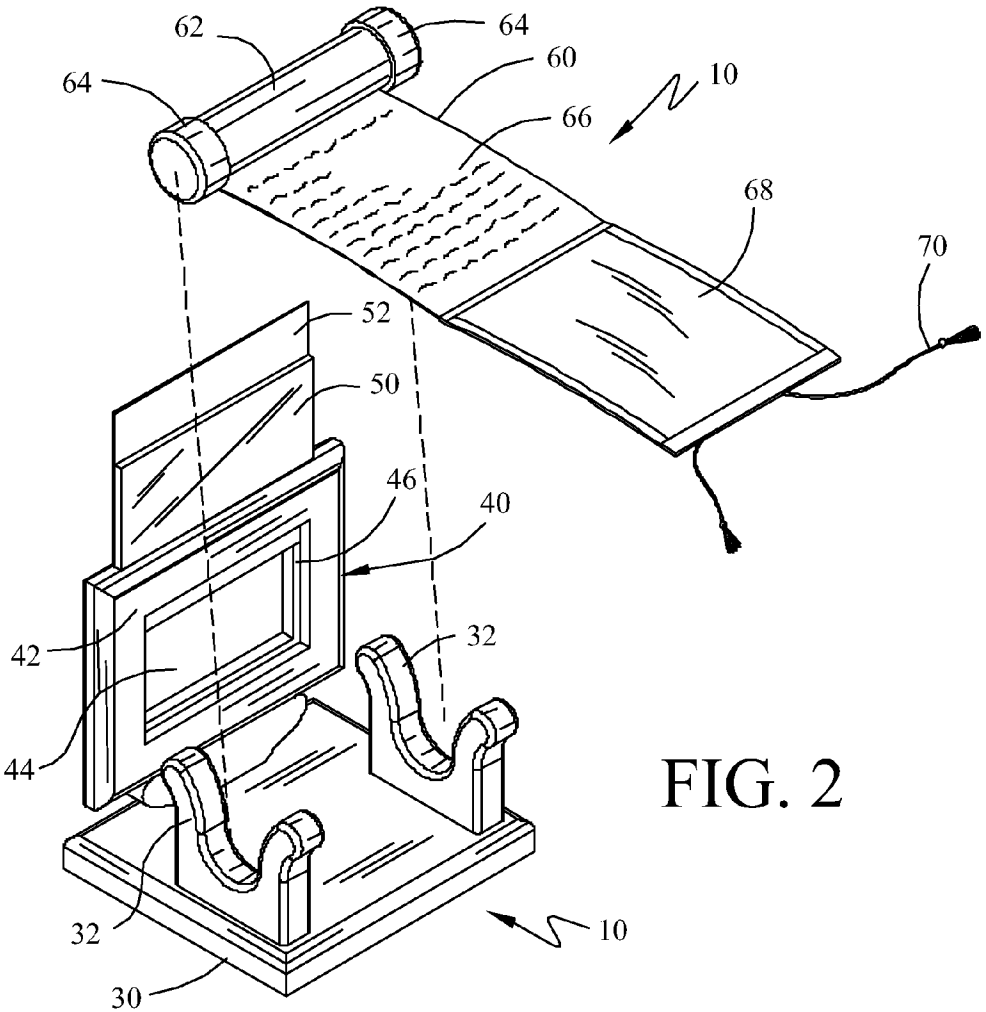
FIG. 2 is a front perspective view of the combination assembly depicted in FIG. 1 showing the scroll removed from the display stand and unfurled to reveal inscribed media.
Figure 1:
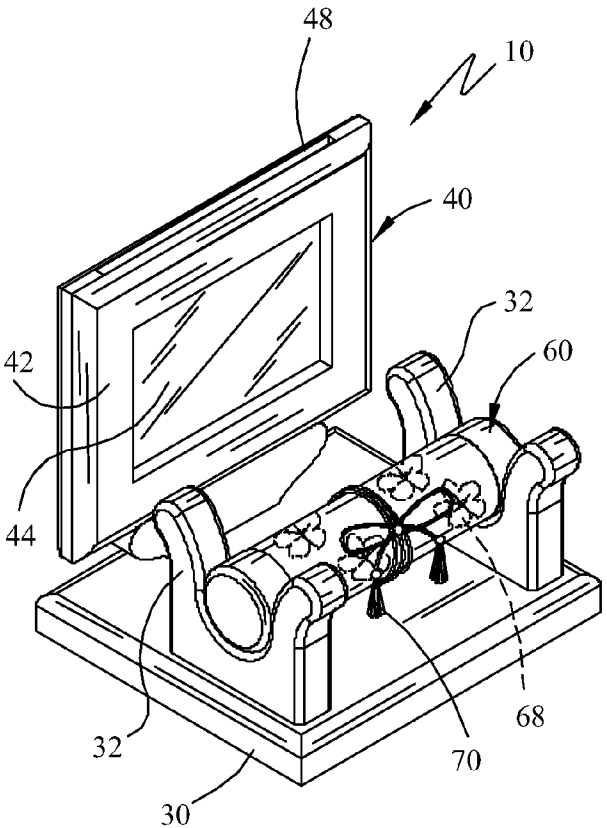
FIG. 1 is a front perspective view of the combination writable scroll picture frame display assembly of the present invention in display mode.

Illustrated in FIGS. 1 and 2, in perspective view from the front, is a first preferred embodiment 10 of the combination writable scroll picture frame display assembly of the present invention. Display assembly 10 comprises an assembly base 30, a right and left support arm 32, a picture frame assembly 40, and a writable scroll 60. Base 30, support arms 32 and picture frame assembly 40 and are typically fabricated from wood, but may also be fabricated from ceramic, plastic, or any other structural material.

Display assembly 40 is mounted to and extends perpendicular upward from the rear aspect of base 30 while support arms 32 are mounted to and extend upward from the front aspect of base 30. Support arms 32 are formed with concave tops to support and cradle writable scroll 60 when scroll 60 is positioned horizontally to lie atop support arms 32. Base 30 is sized and shaped to maintain the assembly 10 in an upright and stable position.

Picture frame assembly 40 comprises an opaque frame 42 that encloses a transparent window 44 through which photographs or other two dimensional graphic media may be viewed. According to the embodiment shown, a slot 48 is formed along the top edge of frame 42 to receive photographs, graphic media and transparent viewing material such as glass or plastic. Slot 48 may also be formed along a side edge such that photographs, cards or artwork can be slid in sideways into window 44, as opposed to from the top of frame 42 as would be the case in the picture frame assembly depicted.

A groove 46, visible in FIG. 2, is formed along the inside edge of frame 42 to receive the edges of photographs or graphics and hold them in place within window 44. Illustrated in FIG. 2 is frame 42 receiving through slot 48 a transparent plastic or glass pane 50 together with a backing plate, photograph or other graphic media 52. Pane 50 with graphic media 52 are slid into window 44 through slot 48 and held in place within frame 42 by groove 46.

FIG. 2 also illustrates the combination assembly 10 with writable scroll 60 removed from support arms 32 and unfurled for viewing. Scroll 60 comprises a spindle 62, each end of which is formed with an end cap 64, a role of writeable media 66, and a scroll cover 68. Writable media 66 may be fabricated from paper, parchment, skins, or other flexible material that is inscribable with ink or pencil. One end of the roll of writable media 66 is permanently adhered to spindle 62 while the other end of the roll of writable media 66 is permanently adhered to cover 68. Media 66 with cover 68 may be furled or unfurled by, alternately, rolling or unrolling media 66 and cover 68 around spindle 62. When completely furled, media 66 and cover 68 are held in place using a tie 70.

Although cover 68 is shown here as attached to one end of the writable portion 66 of scroll 60, cover 68 may also be a separate pouch-like component that is slipped over scroll 60 once the writable media 64 is completely furled. Cover 68 may present a decorative exterior, as illustrated in FIG. 1, or be plain.

Figure 3:
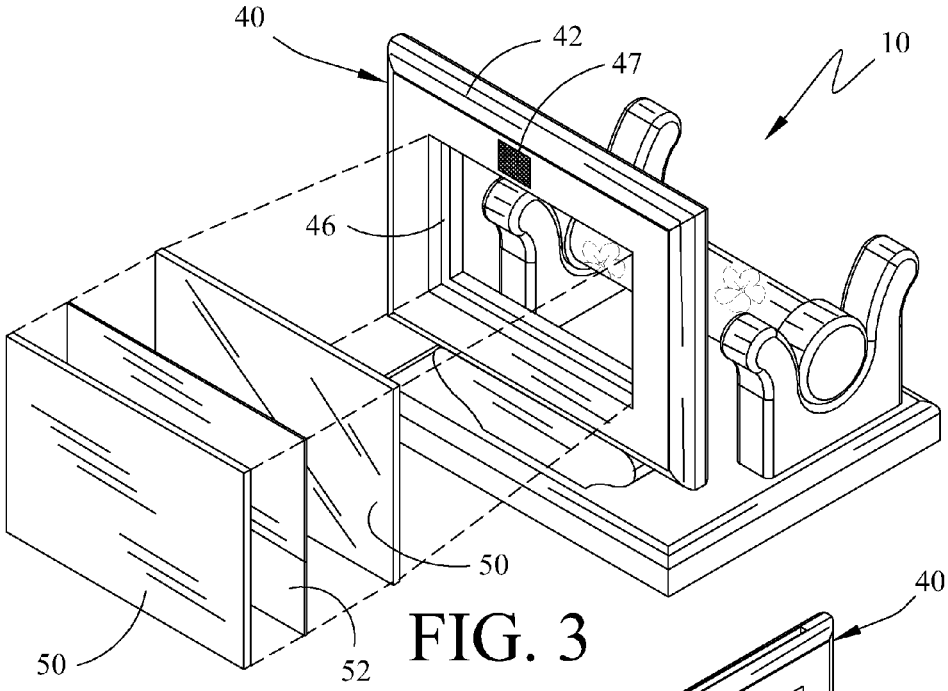
FIG. 3 is a rear perspective view of the combination assembly depicted in FIG. 1 showing in exploded view several components of the picture frame assembly.

Display assembly 10 is illustrated from the rear in FIG. 3 with the internal components of picture frame assembly 40 shown in exploded view. The picture frame assembly 40 shown here is double sided, with window 44 formed in both sides of assembly 40. Photograph 52 is sandwiched between transparent panes 50. Photograph 52 and panes 50 may be slid into assembly 40 from the top or sides, if frame 42 is slotted (as shown in FIGS. 1 and 2), or photograph 52 and panes 50 may be pressed into window 44 of frame assembly 40 if frame 42 is not slotted. In either case, photograph 52 and panes 50 are held in place within frame 42 by grooves 46. Affixed centrally to the top rear of frame 42 is a hanging means 47, depicted in FIG 3. as an eye adapted to receive a hook. Eye hanging means 47 can optionally take the form of other known hanging means.

Although photograph 52 is illustrated in FIG. 3 as sandwiched between two transparent panes 50, photograph 52 may also be sandwiched between a transparent pane and backing plate, and a card or other two-dimensional graphic may be substituted for photograph 52.

Figure 4:
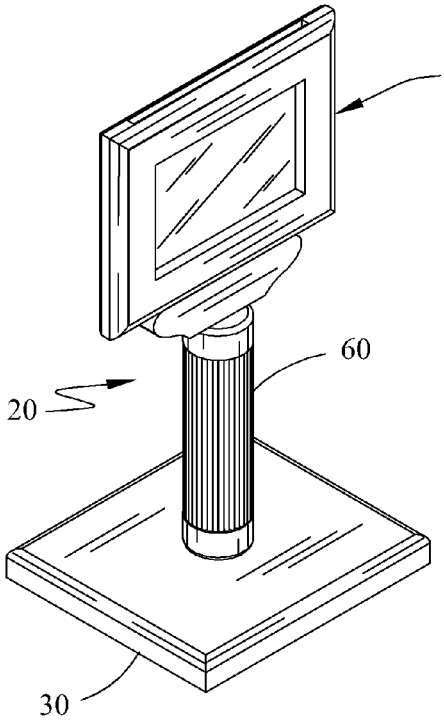
FIG. 4 is a front perspective view of an alternative embodiment of the combination writable scroll picture frame display assembly of the present invention.
Figure 5:
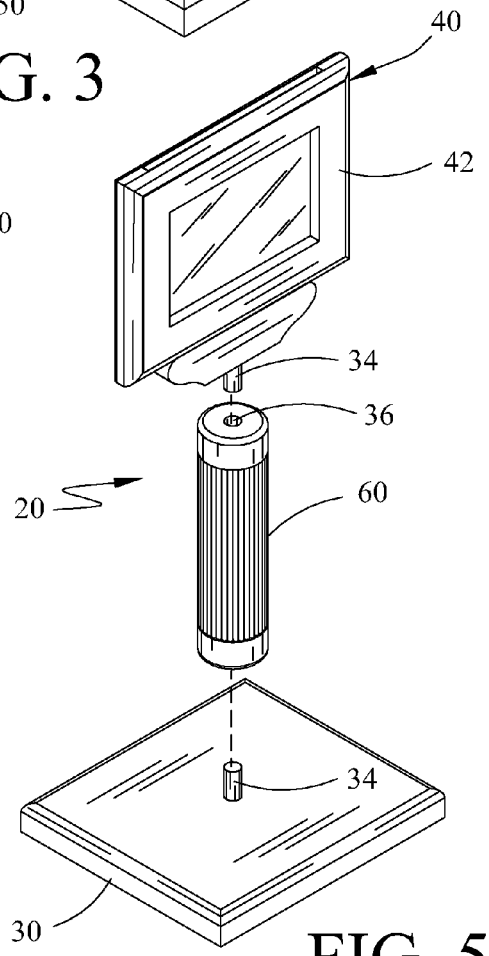
FIG. 5 is a front perspective exploded view of the alternative embodiment combination assembly depicted in FIG. 4 illustrating the detachable nature of the assembly components.

An alternative embodiment 20 combination writable scroll picture frame display assembly is depicted in FIGS. 4 and 5. Like display assembly 10, display assembly 20 is comprised of base 30, picture frame assembly 40 and scroll 60. Whereas display assembly 10 displays scroll 60 horizontally, scroll 60 is displayed in assembly 20 in a vertical position. Scroll 60 extends upwards from a central aspect of base 30, with one end detachably mounted to base 30 while the opposite end is detachably mounted to and supports frame assembly 40.

The manner in which the components of display assembly 20 are detachably connected, one to the other, is illustrated in FIG. 5. A dowel 34 extends up from the middle of the top of base 30 while a second dowel 34 extends downward from the bottom of frame 42. Dowels 34 are received by corresponding holes 36 (only one of which is visible in FIG. 5) drilled in each end of scroll 60. Alternatively scroll 60 can be formed with dowels 34 extending from each or one end, and corresponding drill holes 36 formed on the top of base 30 and/or the bottom of frame 42. Other known manners of detachably connecting the ends of scroll 60 to base 30 and frame assembly 40 can be employed in this embodiment and are considered within the scope, and spirit, of the present invention.

Figure 6:
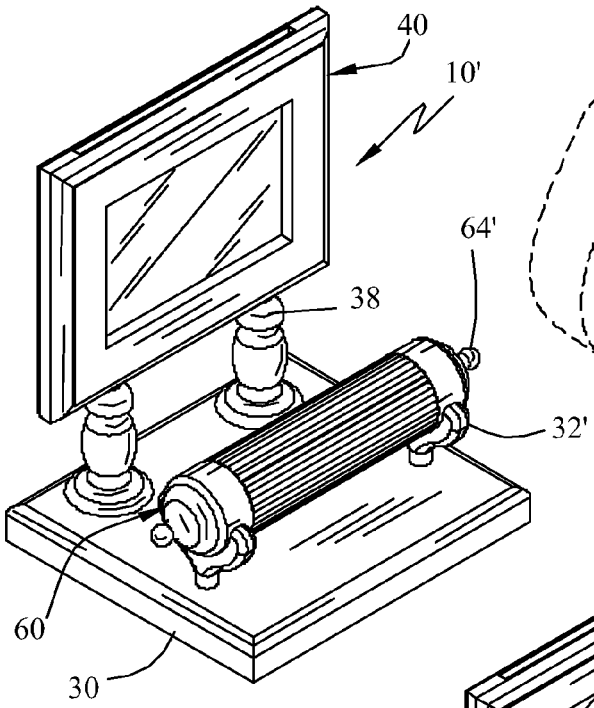
FIG. 6 is a front perspective view of the combination assembly depicted in FIG. 1 exhibiting different ornamental features.
Figure 7:
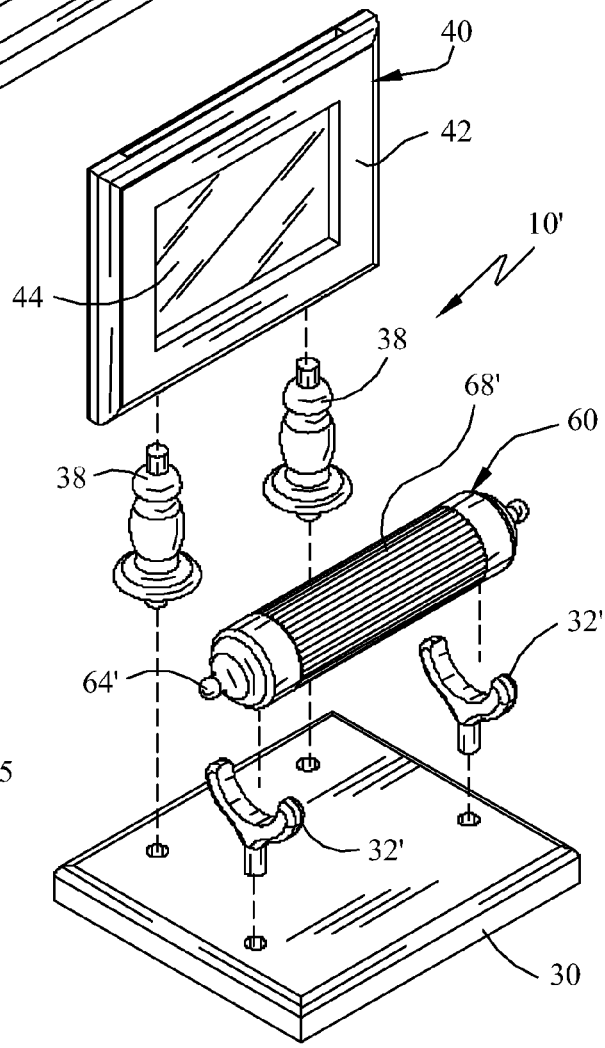
FIG. 7 is a front perspective exploded view of the combination assembly depicted in FIG. 6.

Depicted in FIGS. 6 and 7 in perspective view from the front, with FIG. 7 illustrating components in exploded format, is a modified embodiment 10' of the combination writable scroll picture frame display assembly 10 of the present invention. Display assembly 10' is analogous, structurally, to display assembly 10, and displays scroll 60 horizontally in the same manner as does display assembly 10, but the structural components exhibit different decorative aspects. For example, frame assembly 40 is mounted to the top rear of base 30 using a pair of decoratively carved legs 38, while scroll 60 is supported above base 30 by decoratively carved support arms 32'. The end caps 64' of scroll 60 according to this embodiment are also decoratively carved to match the style exhibited by legs 38 and end caps 64'. Cover 68' of scroll 60 is fabricated from bamboo, for decorative and structural effect.

Figure 8:
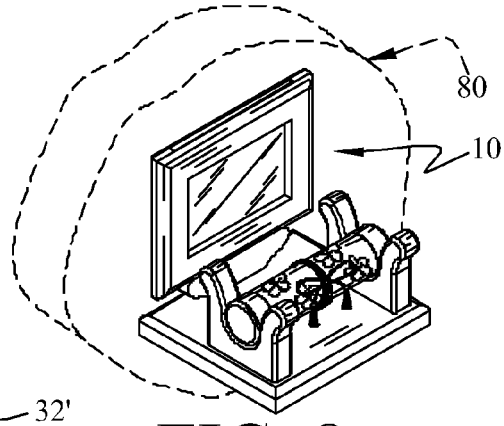
FIG. 8 is a front perspective view of the combination assembly depicted in FIG. 1 mounted on a wall.
Figure 9:
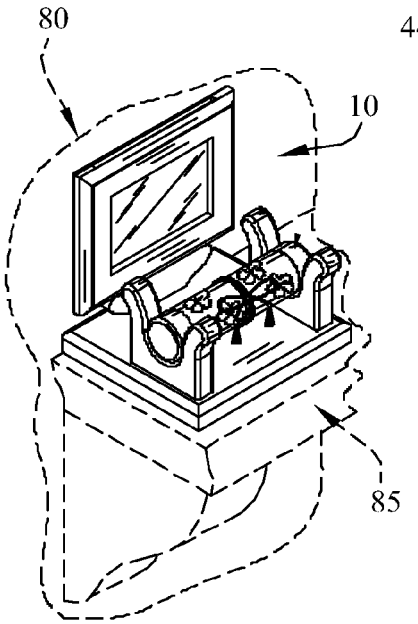
FIG. 9 is a front perspective view of the combination assembly depicted in FIG. 1 sitting on a mantel.

FIGS. 8 and 9 illustrate different manners of displaying the combination writable scroll picture frame display assembly. Depicted in FIG. 8 is preferred embodiment 10 of the display assembly of the present invention mounted on a wall

80. Assembly 10 is made wall mountable by affixing a conventional hanging means (not shown) to the back of picture frame assembly 40. Depicted in FIG. 9 is preferred embodiment 10 of the display assembly of the present invention sitting flat atop a mantel 85. Display assembly 10 may be similarly displayed on other horizontal surfaces such as the shelf of a hutch, display case or curio cabinet. Although only display assembly 10 is illustrated mounted to wall 80, all embodiments of the present invention can be displayed on a wall as shown in FIG. 8, or atop a flat surface as shown in FIG. 9.

SUMMARY AND SCOPE

Accordingly, it will be readily appreciated that the combination writable scroll picture frame display assembly of the present invention provides an attractive and convenient way in which to store inscribable scrolls together with photographs, cards or other two-dimensional graphics that relate to a memorable occasion or event. The display assembly facilitates the easy removal and unfurling of the writable scroll in order to read and exhibit the inscriptions found therein, and the easy remounting of the scroll onto the assembly for continued display. The picture frame and display are mounted such that neither obscures the view of the other and the scroll, and other components of the display assembly, are decorated for aesthetic appeal.

While the present invention has been described in terms of specific structures, specific configurations of structures, and structures having specific decorative aspects, the invention is not limited to these structures, configurations or decorative aspects. Additional and alternative structures and configurations may be utilized and decorated in a variety of manners.

For example, while display assemblies 10, 10' and 20 each exhibit specific decorative motifs, the manners in which the display assembly of the present invention can be decorated are infinite and all such manners may be employed without departing from the spirit and scope of the subject invention. Also, the configuration of the structural components base 30, picture frame assembly 40 and writable scroll 60 are not limited to the two configurations illustrated in FIGS. 1 through 7. Other configurations, whereby the structural components are combined for display, scroll 60 is detachably mounted to the display assembly and, when mounted, does not obscure the view of picture frame assembly 42, can be employed without departing from the spirit or scope of the present invention and are contemplated to be part and parcel of what is claimed herein.

Accordingly, the scope of the invention should be determined by the appended claims and their legal equivalents, rather than with reference to any particular example, embodiment or illustration.

What is claimed is:

1. A display assembly comprising a picture frame, writable scroll and base for supporting the assembly upon a horizontal surface, wherein said picture frame is affixed to and extends upwards from the rear aspect of said base, and wherein said writable scroll is detachably mounted to the forward aspect of said base in a manner so as not to obscure the viewing area of said picture frame, and a hanging means affixed to the rear of said picture frame.

2. The display assembly of claim 1, wherein said writable scroll has decorative end caps.

3. A display assembly comprising a picture frame, writable scroll and base for supporting the assembly upon a horizontal surface, wherein said picture frame is affixed to and extends upwards from the rear aspect of said base, and wherein said writable scroll is detachably mounted to the forward aspect of said base in a manner so as not to obscure the viewing area of said picture frame, wherein said writeable scroll further comprises a cover, and wherein said cover is adhered to and continuous with the free end of the writable portion of said scroll and bound, when fully furled, with a binding means.

4. The display assembly of claim 3 wherein said cover comprises a pouch that is slipped over said scroll when said scroll is fully furled.

5. The display assembly of claim 1, wherein said picture frame has a slot formed along an edge to receive two-dimensional media.

6. The display assembly of claim 1, wherein said picture frame has windows on both sides to allow viewing from either or both sides.

* * * * *